US005556317A

United States Patent [19]

Woolard

[11] Patent Number: 5,556,317

[45] Date of Patent: Sep. 17, 1996

[54] DOLL STAND SET

[76] Inventor: Sharon R. Woolard, Rte. 2, Box 495, Washington, N.C. 27889

[21] Appl. No.: 427,158

[22] Filed: Apr. 24, 1995

[51] Int. Cl.[6] ..... A63H 3/50; A47B 91/00

[52] U.S. Cl. ..... 446/268; 446/69; 248/346.01

[58] Field of Search ..... 446/268, 98, 73, 446/72, 69; 248/346.01, 346.03, 519, 912

[56] References Cited

U.S. PATENT DOCUMENTS

| | | | |
|---|---|---|---|
| D. 246,409 | 11/1977 | Ventura | D6/146 |
| D. 305,920 | 2/1990 | Butler | D21/189 |
| D. 309,932 | 8/1990 | Rivera, Jr. et al. | D21/189 |
| 1,361,628 | 12/1920 | Shailer | 446/73 X |
| 1,640,260 | 8/1927 | Vogel | 446/268 |
| 3,516,632 | 6/1970 | Hall | 248/176 |
| 4,127,251 | 11/1978 | Sapkus et al. | 248/176 |
| 4,597,550 | 7/1986 | Rice, Sr. | 248/346.03 X |
| 4,782,950 | 11/1988 | Santoro | 446/73 X |

FOREIGN PATENT DOCUMENTS

| | | | |
|---|---|---|---|
| 73240 | 9/1960 | France | 446/73 |

*Primary Examiner*—Mickey Yu

*Attorney, Agent, or Firm*—David L. Baker; Henry S. Miller; Rhodes & Ascolillo

[57] ABSTRACT

The invention is a hidden stand for dolls that includes a set of shells, hemispheric, bell or horn shaped adapted to rest on a flat surface containing an opening in the top surface of each shell for receiving the legs and lower torso of a doll. The garment covering the lower torso is spread over the shell where it is appropriately displayed.

2 Claims, 3 Drawing Sheets

DOLL STAND SET

BACKGROUND OF THE INVENTION

1. Field of the Invention

This invention relates to stands for dolls and in particular to a stand set for dolls that will display the craft work of the garments worn by the doll while remaining hidden from view.

2. Description of the Prior Art

Many people spend time crocheting and sewing dresses for dolls. The most common size dolls for show and competition are 11½ and 15 inches in height. Typically these dolls are supported by stands to display the art work and craftsmanship of the clothing by which they are adorned. Doll stands currently available do not support the doll in a fashion that will prevent them from tipping over, prevent the clothing from sagging or bunching up, or show the clothes in the best manner. Doll stands are visible and detract from the appearance of the displayed garment.

Examples of prior art doll stands are seen in U.S. Patents. A very common wire stand for a doll is shown in U.S. Pat. No. 3,516,632 issued Jun. 23, 1970 to Hall. A U.S. Pat. No. Des. 246,409 was issued on Nov. 22, 1977 to Ventura for an ornamental design for a doll stand that is not as common as the wire stand. Sapkus et al. received a patent grant on Nov. 28, 1978 for a doll stand that supports the doll by one leg. This was U.S. Pat. No. 4,127,251. Des. U.S. Pat. No. Des. 305,920 was issued on Feb. 6, 1990 to Butler for another form of doll stand. A wire doll stand is shown in the U.S. Pat. No. Des. 309,932 issued Aug. 14, 1990 to Riveral, Jr. et al.

The cited prior art shows the shortcomings to which this invention is addressed. The doll stands are not constructed in a manner that will allow needle work and crochet work to be displayed in the most advantageous form.

SUMMARY OF THE INVENTION

The invention is characterized by a substantially hemispherical shell that is hidden from view while displaying the doll's garment. The fiat side of the shell is designed to rest on a fiat planar surface and provide stability to the stand. Other shells may be either bell or horn shaped. These other shells fit within the larger hemispherical shell and may be removed when needed. The different shapes account for three different styles of garment that are most often shown on dolls. There is an aperture in the top of each shell at the center, adapted to receive dolls legs, so that when the doll's legs are inserted the figure is in the desired upright position. From the waist up the torso and head of the doll are unobstructed. The shell is formed from plastic or other material that is strong and easily shaped. The color of the shell is important and should be clear, white or some other neutral color which does not show through the intricate lace work and distract from the artistic merits of the dress.

In use the doll is clothed in the desired garment and placed into the support. The folds of the garment are arranged over the stand, so that every aspect of the needlework is visible. The differently shaped shells allow differently styled garments to be shown in the best possible light. Due to the wide diameter base the stand does not tip over like conventional wire stands The stand's continuous clear or light color finish does not show through the open work of the dress pattern and the shape supports the dress so that it does not sag or bunch at the hem. The stand is easily stored and transported from home to show.

It is therefore an object of the invention to provide a new and improved doll stand.

It is another object of the invention to provide a new and improved doll stand that is more stable than any similar known doll stand.

It is a further object of the invention to provide a new and improved doll stand that will display needle work and crochet work better than any known similar device.

It is still another object of the invention to provide a new and improved doll stand that is made from durable and reliable materials.

It is still a further object of the invention to provide a new and improved doll stand that may be easily and efficiently manufactured and marketed.

It is another object of the invention to provide a new and improved doll stand that is inexpensive to make and is therefore susceptible of low prices of sale to the consuming public.

It is another object of the invention to provide a new and improved doll stand that is hidden from view while displaying garments.

These, together with other objects of the invention, along with the various features of novelty which characterize the invention, are pointed our with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF A PREFERRED EMBODIMENT

Figure 1:
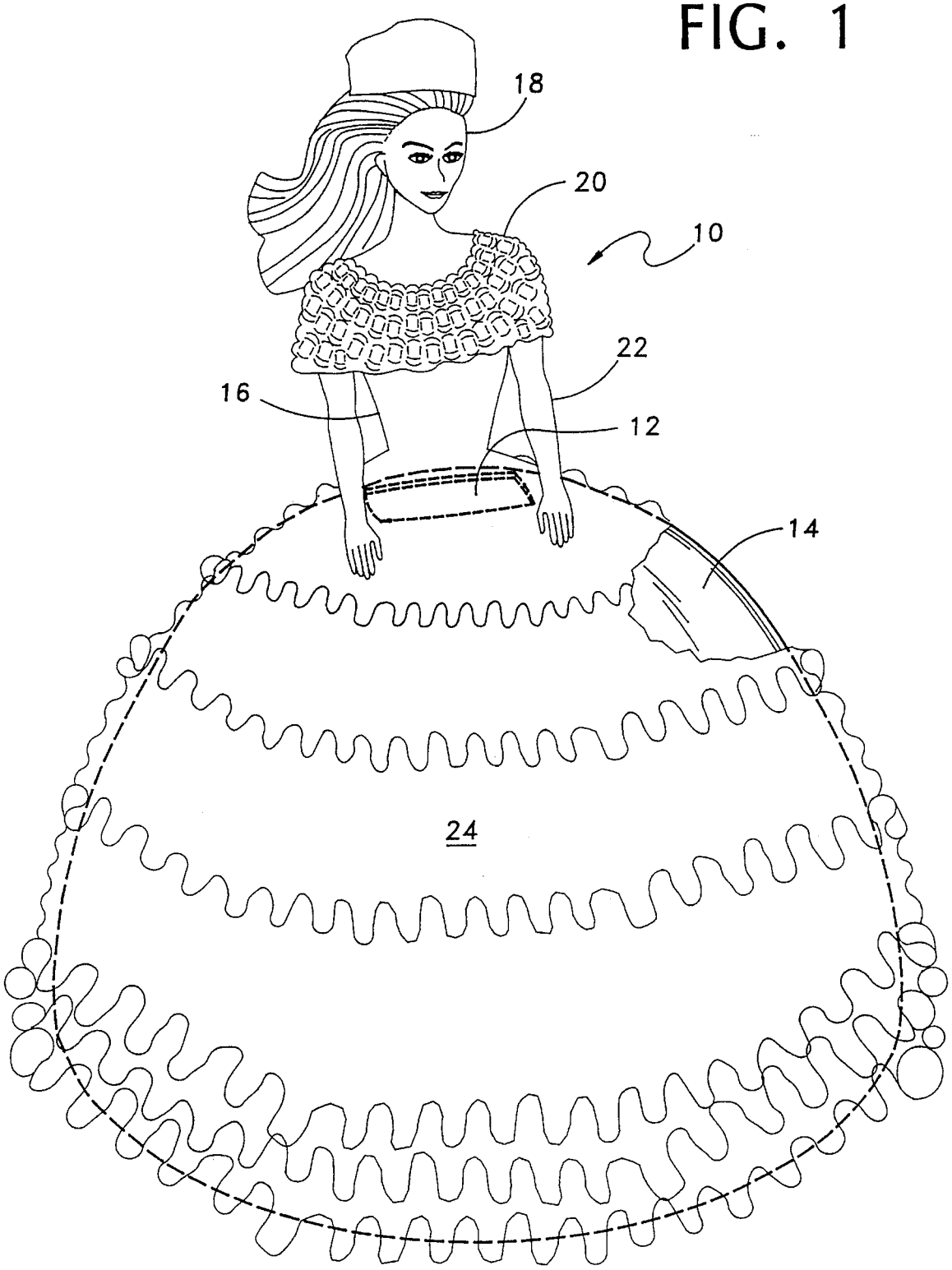
FIG. 1 is an environmental view of the invention.

Referring now to FIG. 1, a female doll is shown generally at 10. The body of the doll from the waist down has been inserted into a slot 12 in the apex region of the hemispherical shaped shell 14. The doll's upper torso 16, head 18, shoulders 20 and arms 22 extend above the shell giving the appearance that the doll is standing without support. The lace, crochet, or fine crafted needle work 24 is spread evenly over shell where it is appropriately displayed.

Figure 2A:
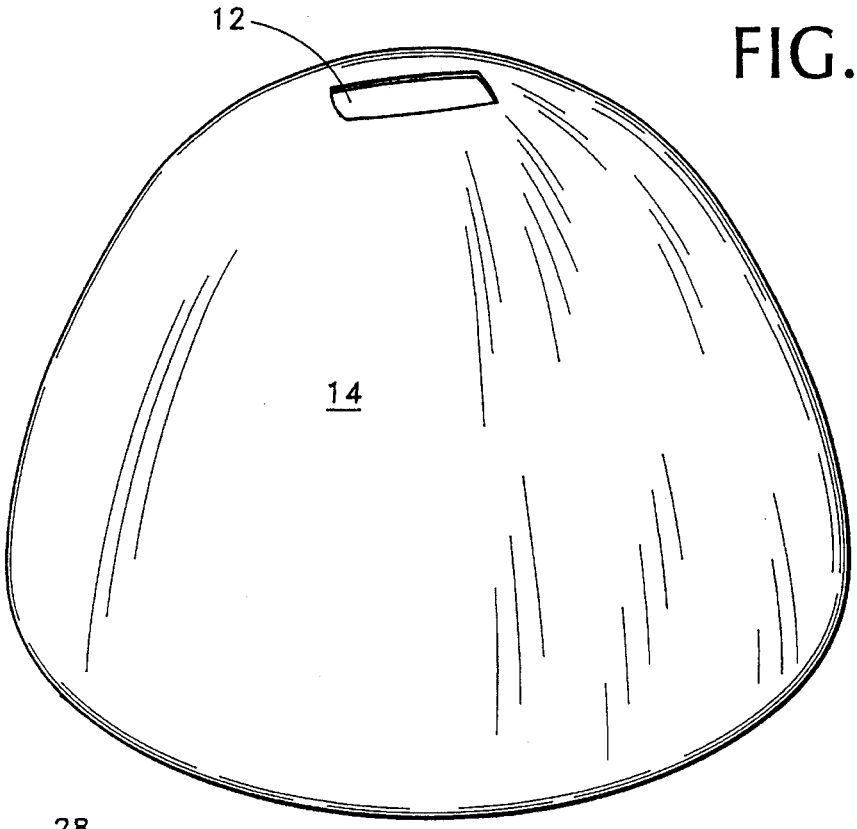
FIGS. 2A, 2B and 2C are perspective views of the shapes of the invention.
Figure 2B:
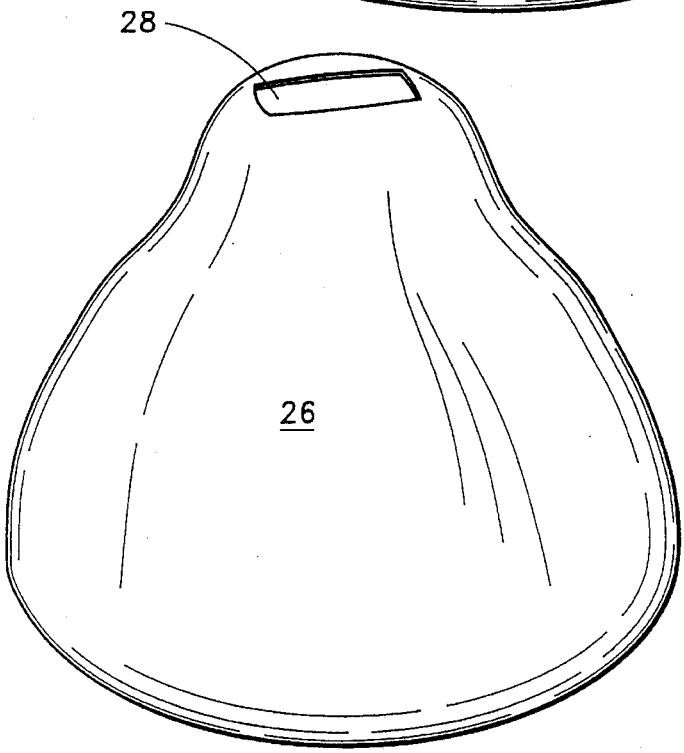
Figure 2C:
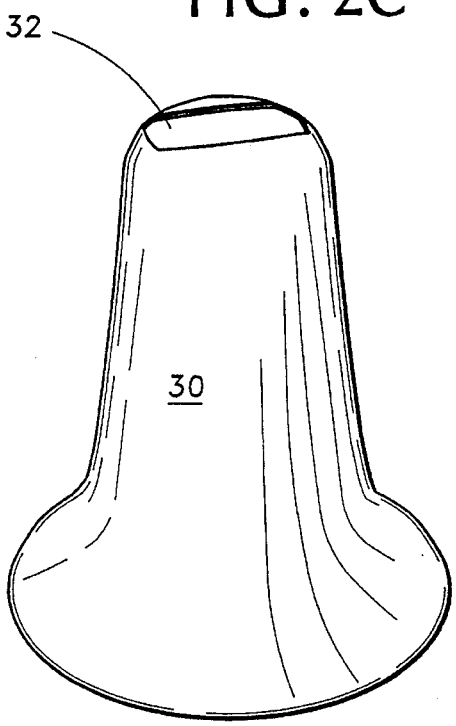

Three common shapes for the shells are shown in FIGS. 2A, 2B and 2C. Shape 14 shown in FIG. 2A is hemispherical and would be used for garments having a large full skirt. The legs and lower torso of the doll would be inside the shell, entering through slot 12. The bell shaped doll stand 26 is shown in FIG. 2B and is used where the skirt is less full than the skirts using shell 14. The lower torso of the doll enters the shell through slot 28. FIG. 2C shows a horn shaped doll stand 30 for garments that hang straight. The lower torso of the doll enter the shell through slot 32.

Figure 3:
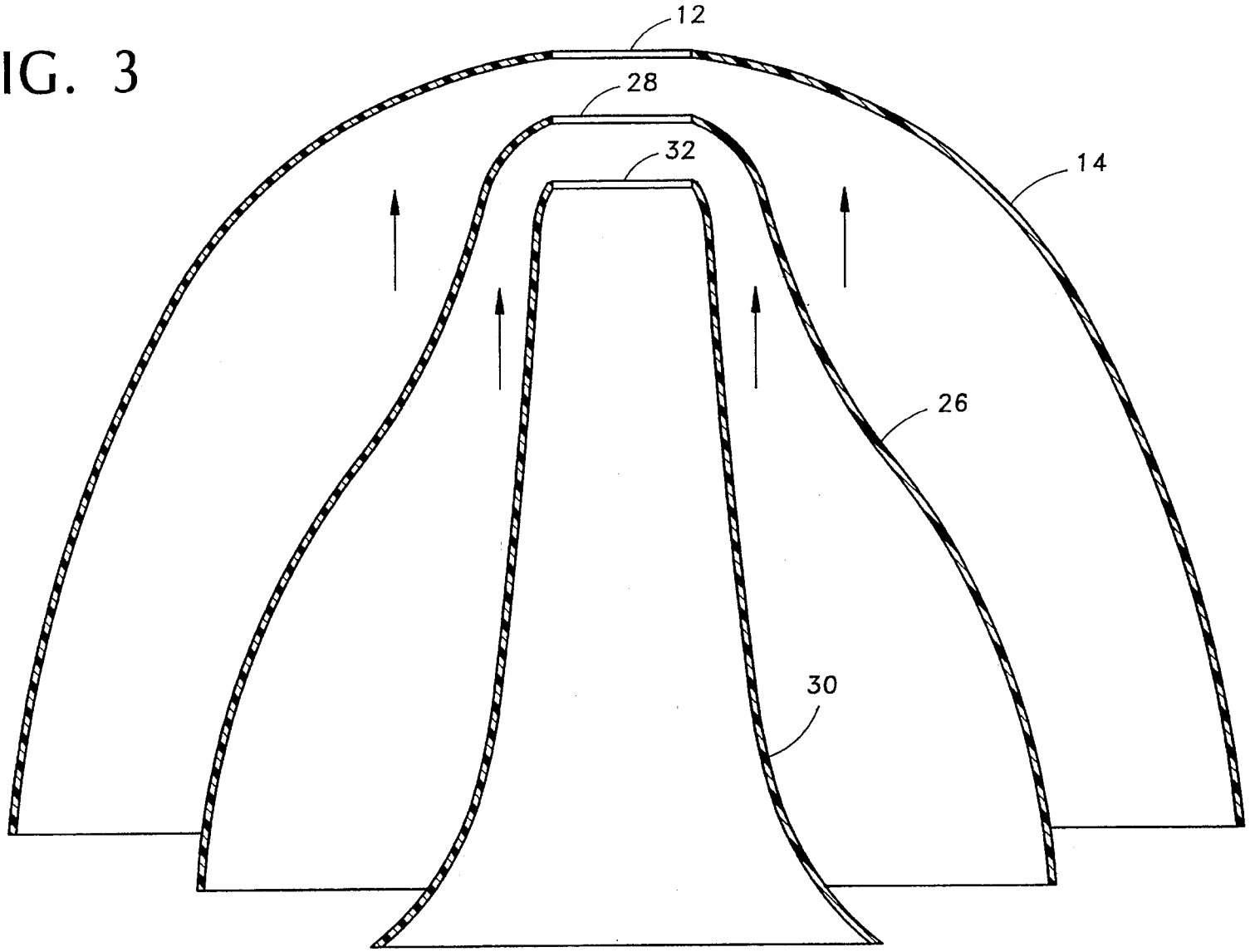
FIG. 3 is a cross sectional view of the invention showing the nested shapes.

FIG. 3 shows shells 14, 26 and 30 as they are nested as if for storage. The top slots are complementary and the shells may remain nested when, for example, outer shell 14 is used to display a garment It should be understood, of course, that the foregoing disclosure relates to only a preferred embodiment of the invention and that numerous modifications ar alterations may be made therein without departing from the spirit and scope of the invention as set forth in the appended claims

What is claimed is:

1. A hidden stand for supporting a doll figure comprising:

a nested set of shells, adapted to rest on a planar surface, having:

a first shell being hemispherical shaped;

a second shell being bell-shaped inside and removable from the first shell;

a third shell being horn-shaped inside and removable from the second shell;

a surface on each shell for displaying garments;

an apex on each of the shells;

an aperture in the apex of the shells of a size and dimension to receive the legs and lower torso of a doll figure;

the aperture of each shell aligned to receive the legs and lower torso of a doll figure when the shells are nested;

whereby a garment worn by the doll figure will over lie and hide the shells.

2. A hidden stand for supporting a doll figure according to claim 1 wherein each shell is formed of a polymeric material.

* * * * *